US007557558B2

(12) United States Patent
Barrow

(10) Patent No.: US 7,557,558 B2
(45) Date of Patent: Jul. 7, 2009

(54) INTEGRATED CIRCUIT CURRENT REFERENCE

(75) Inventor: Jeffrey G. Barrow, Tucson, AZ (US)

(73) Assignee: Analog Devices, Inc., Norwood, MA (US)

( * ) Notice: Subject to any disclaimer, the term of this patent is extended or adjusted under 35 U.S.C. 154(b) by 345 days.

(21) Appl. No.: 11/725,819

(22) Filed: Mar. 19, 2007

(65) Prior Publication Data

US 2008/0231249 A1 Sep. 25, 2008

(51) Int. Cl.
*G05F 3/16* (2006.01)
*G05F 1/10* (2006.01)

(52) U.S. Cl. ..... 323/316; 323/314; 327/539

(58) Field of Classification Search ..... 323/312–316; 327/538–541

See application file for complete search history.

(56) References Cited

U.S. PATENT DOCUMENTS 5,339,020 A * 8/1994 Siligoni et al. ..... 323/313
6,737,909 B2 * 5/2004 Jaussi et al. ..... 327/541
2005/0030273 A1 * 2/2005 Shih et al. ..... 345/94
2007/0046587 A1 * 3/2007 Takahara ..... 345/76
2008/0005598 A1 * 1/2008 Landry et al. ..... 713/300

OTHER PUBLICATIONS

"LCD Panel Power. $V_{COM}$ and Gate Modulation": Analog Devices: ADD8754: Rev. 0; 2005; 28 pp.
"Bias Power Supply for TV and Monitor TFT LCD Panels": Texas Instruments: TPS65160. TPS65160A: SLVS566B-Mar. 2005; Revised Jul. 2005; 28 pp.
"LM3311 Step-Up PWM DC/DC Converter With Integrated LDO, OP-AMP, and Gate Pulse Modulation Switch"; National Semiconductor; Sep. 2006; 30 pp.

* cited by examiner

*Primary Examiner*—Jessica Han
(74) *Attorney, Agent, or Firm*—Koppel, Patrick, Heybl & Dawson

(57) ABSTRACT

An IC current reference includes a reference voltage $V_{ref}$, a current mirror, and a transistor connected between the mirror input and a first I/O pin and which is driven by $V_{ref}$. A resistor external to the IC and having a resistance R1 is coupled to the first I/O pin such that it conducts a current $I_{ref}$ which is proportional to $V_{ref}$/R1; use of a low TC/VC resistor enables $I_{ref}$ to be an accurate and stable reference current. The current mirror provides currents which are proportional to $I_{ref}$, at least one of which is provided at a second I/O pin for use external to the IC. One primary application of the reference current is as part of a regulation circuit for a negative supply voltage channel, which can be implemented with the same number of external components and I/O pins as previous designs, while providing superior performance.

6 Claims, 3 Drawing Sheets

INTEGRATED CIRCUIT CURRENT REFERENCE

BACKGROUND OF THE INVENTION

1. Field of the Invention

This invention relates generally to integrated circuit (IC) current references, and more particularly, to IC current references which provide reference currents for use both internal and external to an IC.

2. Description of the Related Art

Integrated circuits (ICs) often require the use of a reference current. Such currents are used, for example, as a reference for a current limit detection circuit, to generate bias currents, or for any of a number of other purposes.

A reference current is typically generated by applying a reference voltage generated internally to the IC across the terminals of an internal resistor. Such an arrangement is illustrated in FIG. 1. Here, an IC 10 receives a reference voltage $V_{ref}$ from a voltage source (not shown). $V_{ref}$ is buffered with an amplifier 12, and the buffered output 14 is used to drive a transistor 16, shown here as an NMOS FET, though other transistor types could also be used. An internal resistor 18 having a resistance R is connected between the source of FET 16 and one of the IC's input/output (I/O) pins 20, and the FET's drain is connected to the input 22 of a current mirror 24 which is referred to a positive supply voltage V+. I/O pin 20 would typically be connected to a circuit common point 26.

In operation, $V_{ref}$ drives FET 16 to conduct a current $I_{ref}$ which is given by $V_{ref}/R$. Current mirror 24 then produces copies (28) of $I_{ref}$, which can be used for other circuits internal to IC 10 as needed.

Ideally, resistor 18 is a high quality resistor having a low temperature coefficient (TC) and voltage coefficient (VC) and a known resistance value. For example, some IC processes allow the fabrication of thin film resistors, which have both low TC and VC and may have an initial accuracy of 15% or better. However, for some low cost IC processes, thin film resistors are not available, and other types such as polysilicon or diffused resistors must be used. In these cases, initial accuracy may be no better than 30% or more and TCs can be on the order of 1000 ppm/° C. or larger, leading to unacceptably large errors over temperature. If a higher accuracy reference current is needed, errors due to the internal resistor must be corrected and/or compensated for using correction circuits, on-die trimming, additional test time, external circuitry requiring additional pin count, etc. Expensive laser or fuse-blow trimming can improve initial accuracy, but have little to no effect on the internal resistor's non-ideal temperature and voltage characteristics.

Reference voltages and currents generated within an IC are often used by other circuitry which is external to the IC. For example, in FIG. 1, IC 10 is used to provide regulation for a negative supply voltage channel V−. A negative voltage is often generated by means of a charge pump; in FIG. 1, some of the charge pump circuitry (30*a*) is internal to the IC (such as switches, control circuitry, etc.) and some (30*b*) is external (feedback resistors, switches, capacitors, etc.), with the internal and external portions coupled together via an I/O pin 31. Regulation is provided by means of an error amplifier 32, one input of which is connected to circuit common point 26 and the other of which is connected to an I/O pin 34. Pin 34 is connected to the junction 36 of two resistors, one of which (38) is connected between junction 36 and V−, and the other of which (40) is connected between junction 36 and $V_{ref}$ via an I/O pin 42. Resistors 38 and 40 are chosen such that the voltages at the inputs of error amplifier 32 are equal when V− is at a desired value. While the operation of the regulation scheme shown in FIG. 1 is satisfactory, it does require the use of three I/O pins (31, 34, 42) and two resistors (38,40).

Extreme cost pressures on some ICs push manufacturers to use inexpensive IC processes and lower pin count packaging. But as noted above, these inexpensive processes typically lack high quality resistors, so that an internally generated reference current may be unacceptably inaccurate. And a limited pin count may make an application of a high quality current reference for internal bias generation or current limit detection impractical.

SUMMARY OF THE INVENTION

An IC current reference is presented which overcomes the problems noted above, by creating an accurate reference current without requiring a high quality internal resistor. The present invention also makes a copy of the reference current available to circuitry external to the IC.

The present current reference requires an IC having a plurality of I/O pins. The IC contains a voltage source which outputs a reference voltage $V_{ref}$, a current mirror which mirrors a current received at an input to at least one output, and a transistor having its current circuit connected between the current mirror input and a first I/O pin and which is driven by $V_{ref}$.

To create a reference current, a resistor external to the IC and having a resistance R1 is coupled to the first I/O pin such that it conducts a current $I_{ref}$ which is proportional to $V_{ref}/R1$. The current mirror provides currents which are proportional to $I_{ref}$ at respective outputs, at least one of which is provided at a second I/O pin for use external to the IC. Moving the reference current-generating resistance outside of the IC in this way allows a high quality, low TC and VC resistor to be used, and thereby provide a highly accurate and stable reference current.

The reference current made available at the second I/O pin can be used by external circuitry as needed. For example, the externally-available reference current can be used as part of a negative voltage supply regulation circuit which regulates a negative supply voltage channel, without requiring any more I/O pins or external resistors than previous designs. In this way, a highly accurate reference current is generated for use internal and external to an IC, while maintaining the same number of I/O pins and external components as conventional designs.

These and other features, aspects, and advantages of the present invention will become better understood with reference to the following drawings, description, and claims.

DETAILED DESCRIPTION OF THE INVENTION

Figure 2:
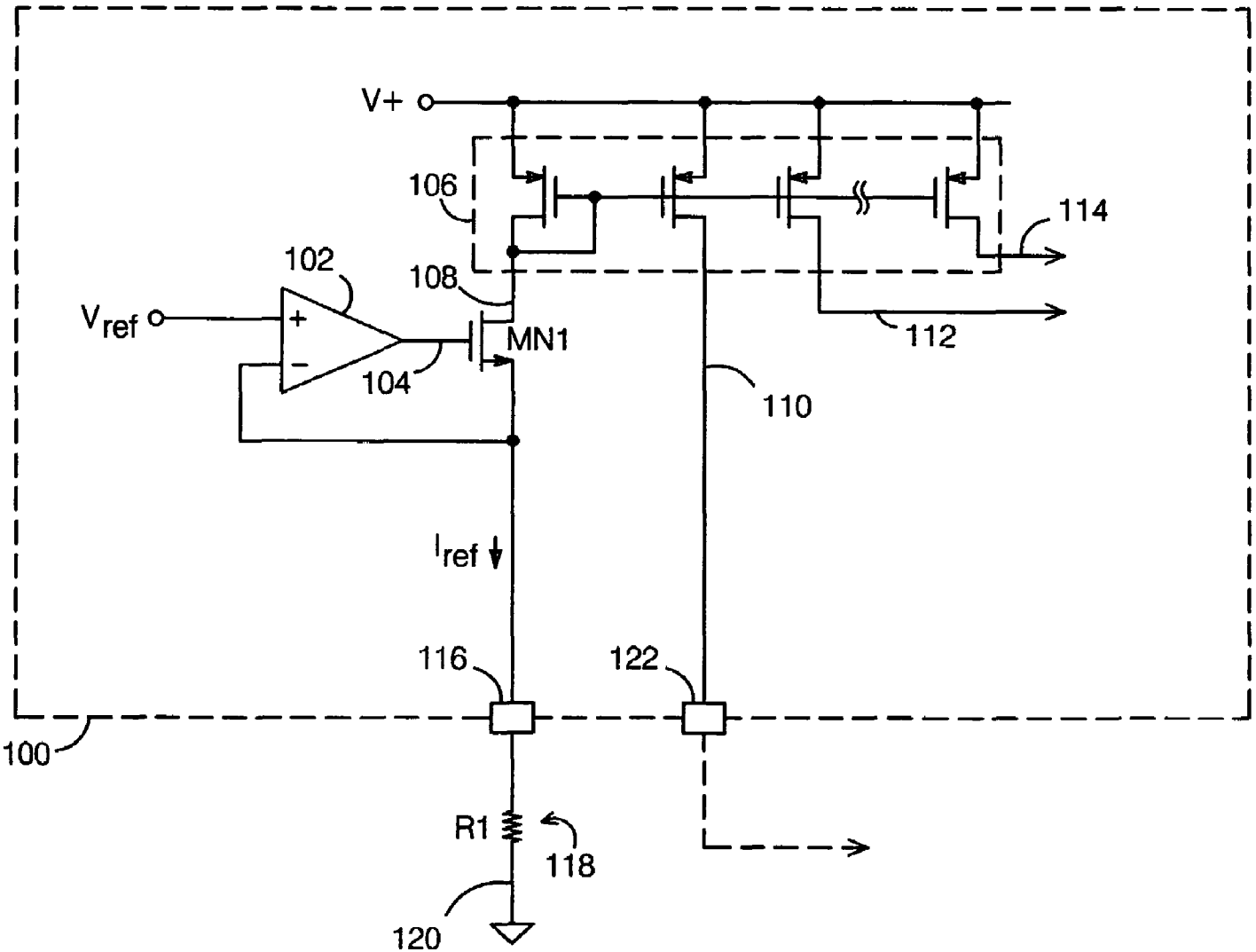
FIG. 2 is a schematic diagram of an IC current reference in accordance with the present invention.

One possible embodiment of an IC current reference in accordance with the present invention is shown in FIG. 2. An IC 100 receives a reference voltage $V_{ref}$ from a voltage source (not shown). $V_{ref}$ is preferably buffered with an amplifier 102, and the buffered output 104 is used to drive a transistor MN1, shown here as an NMOS FET, though other transistor types could also be used. The IC also contains a current mirror 106 referred to a positive supply voltage V+, which has an input 108 and at least one output (110, 112, 114). The transistor's current circuit is connected between the current mirror and one of the IC's I/O pins 116; in this example, MN1's drain is connected to current mirror input 108 and its source is connected to I/O pin 116.

To generate a reference current, an external resistor 118 is connected between I/O pin 116 and a fixed voltage, typically circuit common (120). Resistor 118 has a resistance R1. In operation, $V_{ref}$ drives FET MN1 to conduct a current $I_{ref}$ which is proportional to $V_{ref}$/R1, and is equal to $V_{ref}$/R1 when node 120 is at zero volts. Because there are no other current-consuming connections made to current mirror input 108 or pin 116, all the current through R1 flows in current mirror 106, such that currents proportional to $I_{ref}$ are provided at its outputs (110, 112, 114). The proportionality between $I_{ref}$ and the mirrored currents is determined by the current mirror ratios; assuming 1:1 ratios, the mirrored currents are effectively copies of $I_{ref}$. The mirrored currents can be distributed as needed for use by other internal and/or external circuits. At least one of the mirrored currents is provided at a second I/O pin 122, for use by circuitry external to IC 100.

By arranging the present current reference such that the reference current-generating resistance (R1) is outside of the IC, a user can select a resistor having a desired set of characteristics. Typically, a high quality, low TC and VC resistor would be used. This enables a highly accurate and stable reference current to be generated for use internal and external to IC 100 (assuming that $V_{ref}$ is well-controlled), even if the IC is fabricated using low cost processes that cannot provide high quality resistances. Because a high quality current reference is now available, IC designers can further reduce cost by, for example, decreasing transistor size and the test and/or trim time needed to achieve desired design safety margins.

The ability to employ a low TC and VC resistor to generate a highly accurate and stable reference current, as described herein, can be very advantageous. For example, buck and boost power converters typically include current limit circuits which require a high quality current reference for comparison to a load current. Without such a current reference, both the IC designer and the designer of the printed circuit board (PCB) on which the IC resides may need to over-design their circuits to provide a safety margin which accommodates undesirable operating possibilities. For instance, generating a reference current using a resistor having a TC of 1000 ppm/° C. results in a 10% increase/decrease in output current limit over a 100° C. operating range. Consequently, an IC designer would need to increase a device's metal and silicon die area by 10% to accommodate the possible increase in maximum current. These problems can be largely avoided by using a high quality, low TC and VC external resistor to generate a reference current, in accordance with the present invention.

Figure 3:
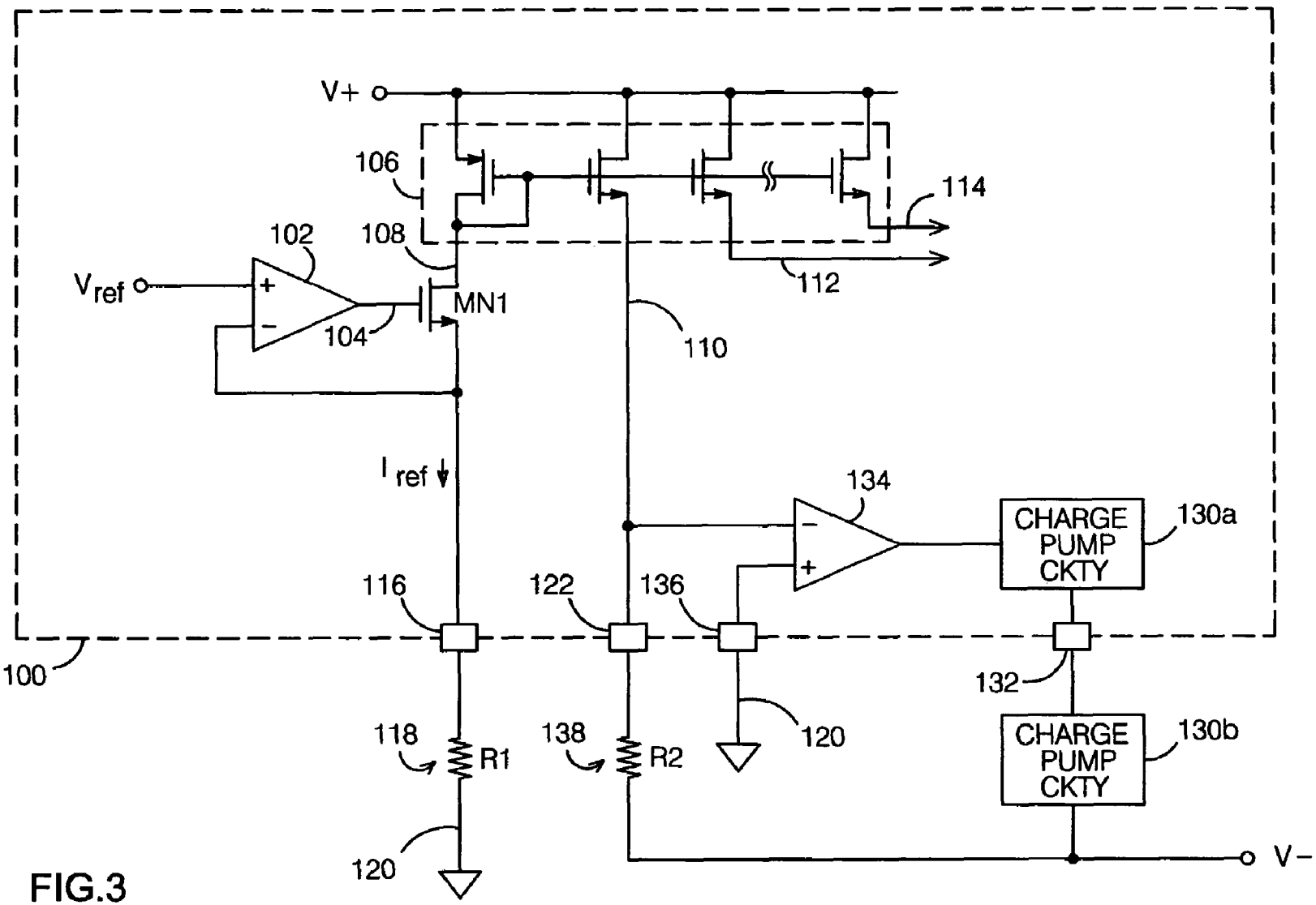
FIG. 3 is a schematic diagram of an IC current reference in accordance with the present invention, and one possible application of the externally-available reference current.

An IC current reference and one primary application of the externally-available copy of reference current $I_{ref}$ is shown in FIG. 3. The reference current generation as is shown in FIG. 2: a buffered version of $V_{ref}$ is applied across resistor 118 to produce a reference current $I_{ref}$ given by $V_{ref}$/R1 (when node 120 is at zero volts). Current mirror 106 produces copies of $I_{ref}$ at its outputs (110, 112, 114) (assuming 1:1 ratios), at least one of which (110 in this example) is provided at second I/O pin 122.

In this application, the reference current at I/O pin 122 is used to regulate a negative supply voltage V−. The negative voltage may be generated by many different means; in this example, a charge pump is used. In FIG. 3, some of the charge pump circuitry (130*a*) is internal to IC 100 (such as switches, control circuitry, etc.) and some (130*b*) is external (feedback resistors, switches, capacitors, etc.), with the internal and external portions coupled together via an I/O pin 132; the charge pump is arranged to vary voltage V− in response to a control signal. Regulation is provided by means of an error amplifier 134, the output of which provides the charge pump control signal, one input of which is connected to circuit common via an I/O pin 136, and the other input of which is connected to I/O pin 122. A second resistor 138 having a resistance R2 is connected between I/O pin 122 and V−. Resistance R2 is selected such that the voltages at the inputs of error amplifier 134 are equal when V− is at a desired value.

Figure 1:
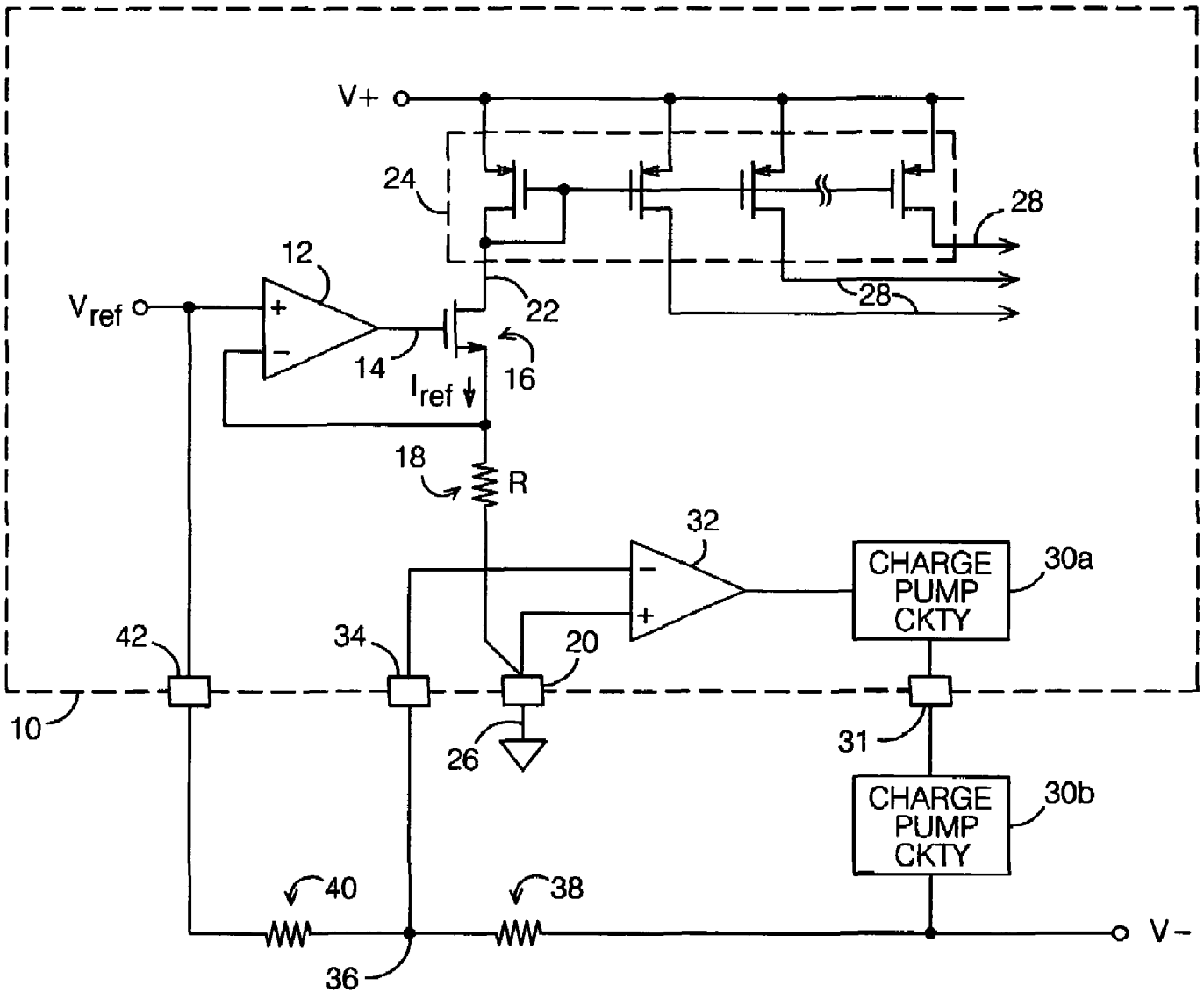
FIG.1 (Prior Art)
FIG. 1 is a block/schematic diagram of a known IC current reference.

Note that, in addition to providing an accurate current reference, the circuit arrangement shown in FIG. 3 provides regulation of a negative supply voltage channel without increasing pin count: the circuit of FIG. 3 requires the same number of I/O pins and external resistors as the conventional arrangement shown in FIG. 1. In effect, one of the two external resistors required by the conventional regulation scheme is no longer needed. This enables a low TC/VC external resistor to be employed to generate a much more accurate reference current, without increasing the required component or I/O pin count.

Thus, using an arrangement such as that shown in FIG. 3, and IC manufacturer can use low pin count packaging and inexpensive IC processes with low quality internal resistors, and still meet the accuracy requirements presented by critical circuitry such as timing, clock generation, precise current limiting and bias current generation.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

I claim:

1. A current reference for generating reference currents for use internal and external to an integrated circuit (IC), comprising:

an IC having a plurality of input/output (I/O) pins;

a voltage source within said IC which outputs a reference voltage $V_{ref}$;

a current mirror which mirrors a current received at an input to at least one output;

a transistor having its current circuit connected between said current mirror input and a first one of said I/O pins and which is driven by $V_{ref}$;

a first resistor external to said IC and having a resistance R1, said first resistor coupled to said first I/O pin such that said first resistor conducts a current $I_{ref}$ which is proportional to $V_{ref}$/R1, said current mirror providing currents which are proportional to $I_{ref}$ at respective ones of its outputs, one of said mirrored currents provided at a second one of said I/O pins for use external to said IC;

circuitry external to said IC which requires a reference current, said external circuitry coupled to said second I/O pin, said circuitry comprising a negative voltage supply regulation circuit which regulates a negative supply voltage channel;

wherein said negative supply voltage channel is accessible external to said IC, further comprising:

a negative supply voltage generation circuit which provides said negative supply voltage to be regulated, said negative supply voltage generation circuit arranged to vary said negative supply voltage in response to a control signal;

wherein said negative voltage supply regulation circuit comprises:

a second resistor external to said IC and connected between said second I/O pin and said negative supply voltage channel such that said second resistor conducts a current which is proportional to Iref; and an error amplifier having first and second inputs and an output, said output providing said control signal to said negative supply voltage generation circuit, said first input coupled to said second I/O pin and said second input coupled to a second reference voltage, said error amplifier arranged to provide said control signal so as to drive the difference between the voltages at said first and second inputs toward zero.

2. The current reference of claim 1, wherein said second reference voltage is zero volts and said second resistor is selected such that the voltage at said error amplifier's first input is zero volts when said negative supply voltage is at a desired value.

3. The current reference of claim 1, wherein said negative supply voltage generation circuit is a charge pump.

4. A negative supply voltage regulation circuit for regulating a negative voltage channel which is external to an integrated circuit (IC), comprising:

a negative supply voltage generation circuit which provides a negative supply voltage, said negative supply voltage generation circuit arranged to vary said negative supply voltage in response to a control signal; and a current reference for generating reference currents for use internal and external to said IC, comprising:

an IC having a plurality of input/output (I/O) pins;

a voltage source within said IC which outputs a reference voltage $V_{ref}$;

a current mirror which mirrors a current received at an input to at least one output;

a transistor having its current circuit connected between said current mirror input and a first one of said I/O pins and which is driven by $V_{ref}$;

a first resistor external to said IC and having a resistance R1, said first resistor coupled to said first I/O pin such that said first resistor conducts a reference current $I_{ref}$ which is proportional to $V_{ref}$/R1, said current mirror providing currents which are proportional to Iref at respective ones of its outputs, one of said mirrored currents provided at a second one of said I/O pins;

wherein said negative voltage supply regulation circuit comprises:

a second resistor external to said IC and connected between said second I/O pin and said negative supply voltage channel such that said second resistor conducts a current which is proportional to $I_{ref}$; and an error amplifier having first and second inputs and an output, said output providing said control signal to said negative supply voltage generation circuit, said first input coupled to said second I/O pin and said second input coupled to a second reference voltage, said error amplifier arranged to provide said control signal so as to drive the difference between the voltages at said first and second inputs toward zero.

5. The regulation circuit of claim 4, wherein said IC is made with a fabrication process which lacks thin film resistors.

6. The regulation circuit of claim 4, wherein said first resistor has low temperature and voltage coefficient characteristics.

* * * * *